US012247375B2

(12) United States Patent
Walser et al.

(10) Patent No.: US 12,247,375 B2
(45) Date of Patent: Mar. 11, 2025

(54) SANITARY DRAIN UNIT

(71) Applicant: Neoperl GmbH, Müllheim (DE)

(72) Inventors: Dietmar Walser, Efringen-Kirchen (DE); Holger Schürle, Müllheim (DE)

(73) Assignee: Neoperl GmbH, Müllheim (DE)

( * ) Notice: Subject to any disclaimer, the term of this patent is extended or adjusted under 35 U.S.C. 154(b) by 544 days.

(21) Appl. No.: 17/611,619

(22) PCT Filed: May 15, 2020

(86) PCT No.: PCT/EP2020/063636
§ 371 (c)(1),
(2) Date: Nov. 16, 2021

(87) PCT Pub. No.: WO2020/229665
PCT Pub. Date: Nov. 19, 2020

(65) Prior Publication Data

US 2022/0243435 A1 Aug. 4, 2022

(30) Foreign Application Priority Data

May 16, 2019 (DE) ..... 202019102785.1

(51) Int. Cl.
*E03C 1/04* (2006.01)
*E03C 1/084* (2006.01)

(52) U.S. Cl.
CPC ..... *E03C 1/0404* (2013.01); *E03C 1/084* (2013.01)

(58) Field of Classification Search
CPC ..... E03C 1/0404; E03C 1/084; E03C 1/086; Y10T 137/9464
USPC ..... 137/801
See application file for complete search history.

(56) References Cited

U.S. PATENT DOCUMENTS

| | | | | |
|---|---|---|---|---|
| 5,555,912 | A | 9/1996 | Saadi et al. | |
| 2008/0178942 | A1 | 7/2008 | Pinette et al. | |
| 2010/0071778 | A1 | 3/2010 | Nelson et al. | |
| 2010/0127101 | A1* | 5/2010 | Stadtler | E03C 1/086 239/600 |
| 2014/0300010 | A1* | 10/2014 | Zhou | E03C 1/084 261/78.2 |
| 2015/0115063 | A1* | 4/2015 | Bammerlin | E03C 1/0404 239/428.5 |

FOREIGN PATENT DOCUMENTS

| | | |
|---|---|---|
| CN | 104032802 | 9/2014 |
| CN | 109477330 | 3/2019 |
| DE | 9317654 U1 | 3/1994 |
| DE | 202013002189 | 7/2014 |

(Continued)

*Primary Examiner* — Daphne M Barry
(74) *Attorney, Agent, or Firm* — Volpe Koenig

(57) ABSTRACT

A sanitary outflow unit (1) to be used in a water dispensing device (20), having a water supply (3) and a water outlet (4), which sanitary outflow unit includes at least one holding element (11) that can be switched between a release position and a holding position, wherein, in the holding position, a peripheral contour (18) of the sanitary outflow unit (1) is enlarged by the holding element (11). The holding element (11) includes in particular a bending element (12) having a holding lug (13) which, in the holding position of the holding element (11), engages behind a wall (22) of an installation opening (21) in the water dispensing device (20).

23 Claims, 9 Drawing Sheets

(56) References Cited

FOREIGN PATENT DOCUMENTS

| | | | |
|---|---|---|---|
| DE | 102013017781 | B4 | 5/2019 |
| DE | 102020131091 | A1 | 5/2022 |
| EP | 2586919 | | 5/2013 |
| WO | 2013162359 | | 10/2013 |

* cited by examiner

SANITARY DRAIN UNIT

TECHNICAL FIELD

The invention discloses a sanitary outflow unit for insertion into a water dispensing device, having a water connection and a water outlet.

Such sanitary outflow units are known in the prior art, with installation in a water dispensing device being intricate and complex to some extent.

SUMMARY

The object of the invention is therefore to simplify installation in a water dispensing device.

This object is achieved by a sanitary outflow unit having one or more of the features disclosed herein.

In particular, the sanitary outflow unit according to the invention is characterized in that it has at least one holding element, which can be switched between a release position and a holding position, wherein the sanitary outflow unit has a larger peripheral contour in the holding position than in the release position.

The peripheral contour may correspond for example to the largest possible installation opening into which the sanitary outflow unit can be inserted. An enlargement of this peripheral contour would then result in the sanitary outflow unit being held in the installation opening, for example in a form-fitting and/or force-fitting manner. In this case, the peripheral contour does not correspond to the actual largest periphery of the sanitary outflow unit. This actual largest periphery may be formed for example by a border or a front panel, which is not inserted into the installation opening but for example rests against a wall of an item of furniture.

The actual installation opening may likewise be smaller than the peripheral contour, in that the installation opening replicates rounded portions of the sanitary outflow unit, for example.

In an advantageous embodiment, the holding element is in the form of an elastic bending element. For example, the bending element may be in a holding position in its relaxed state and may be moved into a release position by the wall of the installation opening when the sanitary outflow unit is being inserted into an installation opening, and in the inserted state may spring back into its original holding position again. In this case, it is possible for a force fit and/or a form fit with the wall to occur in the holding position, for example.

In an expedient refinement, the sanitary outflow unit has a locking element, which can be displaced in order to move, in particular bend, or hold the holding element between a first position, in which the holding element is in its release position, and a second position, in which the holding element is in its holding position. The locking element may for example hold the bending element in its holding position, with the result that removal from the installation opening is prevented.

In this respect, it is also possible that the bending element is in the release position in its relaxed state and is moved into its holding position by the locking element.

It may be advantageous here if the peripheral contour runs peripherally around the locking element at least in its holding position.

In an advantageous embodiment, the sanitary outflow unit has at least one arresting means, which interacts with a further arresting means in the holding position. The arresting means may be a groove that interacts with a latching lug, for example.

In particular, it is expedient if the further arresting means is arranged on the holding element and/or on a locking element and/or on a housing wall.

In a further embodiment of the invention, in the holding position the holding element enlarges a peripheral contour of the sanitary outflow unit.

The peripheral contour may substantially define the installation dimension of the sanitary outflow unit, in particular the maximum size of an installation opening in a water dispensing device, or of a part of the outflow unit. In this case, the peripheral contour is not necessarily an actual peripheral contour of the sanitary outflow unit. It may also be spanned by individual points on the sanitary outflow unit, for example in the manner of a rubber band. Accordingly, the physical extent of the sanitary outflow unit in certain locations may be smaller than the spanned peripheral contour. The peripheral contour may in particular go around the holding element.

In this case, the holding element is formed such that it enlarges this peripheral contour in its holding position. This makes it possible to exert a clamping stress on a wall of an installation opening, for example. However, it is also possible for the holding element to engage behind a wall of a water dispensing device.

The holding element may be in the form of a rotatable eccentric disk or helical object, for example.

In one embodiment, the holding element is formed such that it can engage behind and/or engages behind a wall of a water dispensing device at least partially in the holding position. For example, the wall may form a holding edge of a fitting.

In one advantageous embodiment, the locking element is in the form of a pin. In this case, the pin can preferably be moved in its direction of axial extent within the holding element.

The locking element, in particular the pin, may practically have any desired form. It may for instance have an angular, in particular triangular to pentagonal, cross section. In an expedient embodiment, the locking element has a round or oval cross section In an advantageous embodiment, in the region of the holding element the sanitary outflow unit has an introduction opening for introducing a locking element.

The introduction of the locking element preferably moves the holding element into the holding position and/or holds it there.

Expediently, the locking element can be removed completely from the opening. In this way, the locking element may be in the form of a separate element that can be taken completely out of the holding element. In this case, it may also be expedient if the locking element can be pushed through inward for the purpose of removal, with the result that it does not require handling to be pulled out and terminates flush with the sanitary outflow unit in its second position, for example.

In one embodiment, the sanitary outflow unit and/or the holding element has a sliding surface, on which the locking element is supported when being introduced into the opening in order to move the holding element. The sliding surface thus acts on one side as an abutment, by way of which the locking element can exert a bending or holding force on the holding element.

In an advantageous embodiment, the sliding surface and the locking element each have an arresting means, which arresting means interact when the locking element is completely inserted.

In principle, the sanitary outflow unit may have a plurality of holding elements, with the result that a secure hold is ensured.

In an alternative embodiment, the sanitary outflow unit has a border, which defines an in particular circular peripheral contour. In this way, the sanitary outflow unit can be insertable in a fitting, for example.

In one embodiment, the bending element is in the form of a bending web. In this case, the bending element is preferably held on one side or on two sides. In particular, the bending element can be deformed transversely to a direction of insertion of the sanitary outflow unit.

In one embodiment, the bending element is formed by an arcuate recess in the border of the sanitary insert part.

In one embodiment, the or a holding lug is arranged on the radial outer surface of the bending element, in particular with the holding lug extending in the axial direction approximately over half of the height of the border of the sanitary outflow device. Here, the holding lug projects beyond the border of the sanitary outflow unit radially outward. In this way, the holding element enlarges the peripheral contour in its holding position.

In one embodiment, the holding lug has a slope, with the result that the radial extent decreases toward an inner edge of the sanitary outflow unit or of the border. In this respect, it may be provided that a holding edge, which can engage behind a holding edge of a fitting, is arranged on that axial end of the holding lug that faces away from the inner edge.

In one embodiment, a plurality of similar holding elements are arranged distributed along the border, preferably homogeneously. In this way, a secure fastening of the sanitary outflow unit is possible. The sanitary outflow unit preferably has more than two, particularly preferably more than four, in particular six or more, holding elements.

In one embodiment, in the peripheral direction the bending elements are longer overall than half of the periphery of the border. In particular, in the peripheral direction the bending elements are each longer than the webs between the bending elements.

In one embodiment, on a side facing away from the holding element the sanitary outflow unit has a support, which can engage behind or engages behind a wall of a water dispensing device. In this way, the number of holding elements required can be reduced, and therefore only one or two holding elements are necessary, for example.

The water connection may be formed in accordance with a customary standard. In one embodiment, the water connection is in the form of a plug-in connection. In this way, a simple and secure connection to a water supply is possible.

It can be particularly expedient if a valve is arranged in the water connection, preferably connected via a hose to a basic body that bears the holding element.

The sanitary outflow unit has a water outlet, which may have a jet regulator, a flow restrictor and/or a screen. In any desired combination, these may form a unit or be formed in one piece with the sanitary outflow unit.

In an advantageous embodiment, the sanitary outflow unit has a receptacle for inserting a jet regulator, in particular an internal thread for screwing in a jet regulator. In this way, the jet regulator can be exchanged or cleaned easily.

The invention also comprises the use of a sanitary outflow unit in a water dispensing device, wherein the water dispensing device has an installation opening matched to the peripheral contour of the sanitary outflow unit and the holding element engages behind a wall of the water dispensing device, in particular of the installation opening, in its holding position. The wall may form a holding edge of a fitting, for example.

The invention likewise comprises a water dispensing device, in particular an item of furniture, having a sanitary outflow unit according to the invention.

BRIEF DESCRIPTION OF THE DRAWINGS

The invention is explained in more detail below on the basis of an advantageous exemplary embodiment and with reference to the appended drawings.

In the drawings:

FIG. 1, FIG. 5: shows an exploded representation of the water dispensing device of FIG. 4, FIG. 6: shows a representation of the water dispensing device of FIG. 4 with free locking elements.

DETAILED DESCRIPTION

Figure 1:
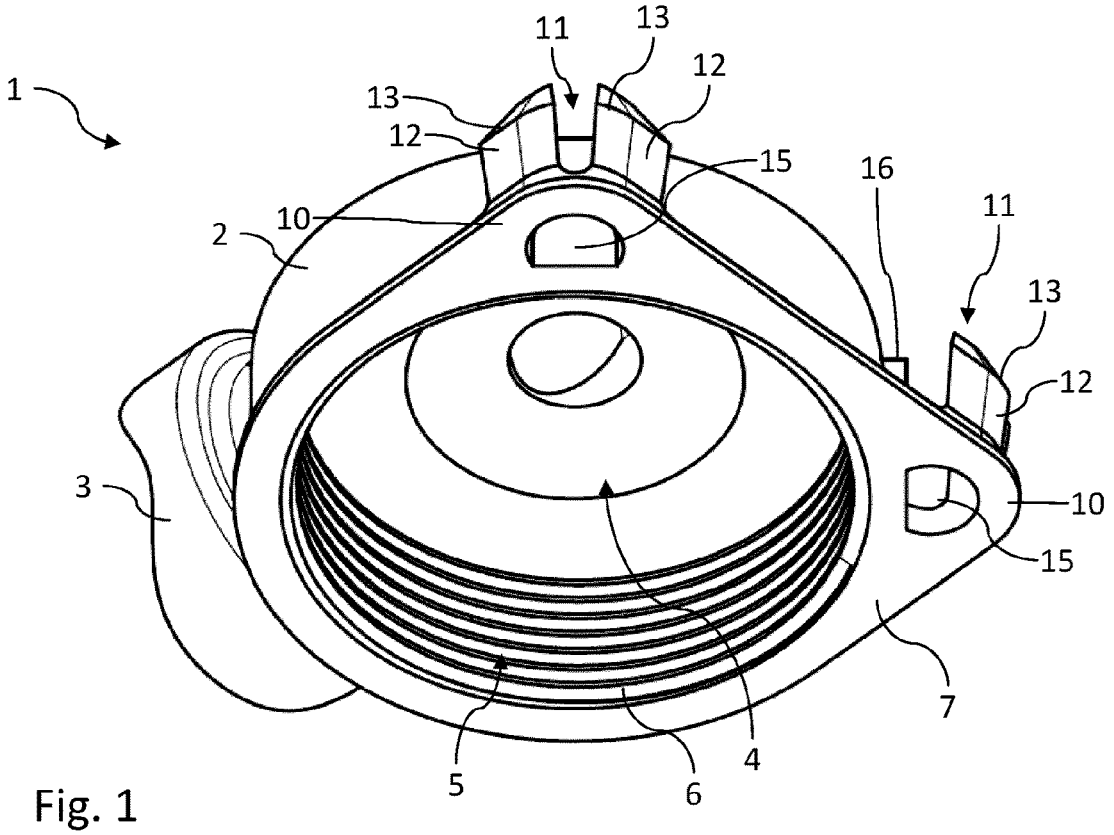
FIG. 1: shows an oblique view from below of a first sanitary outflow unit according to the invention.
Figure 2:
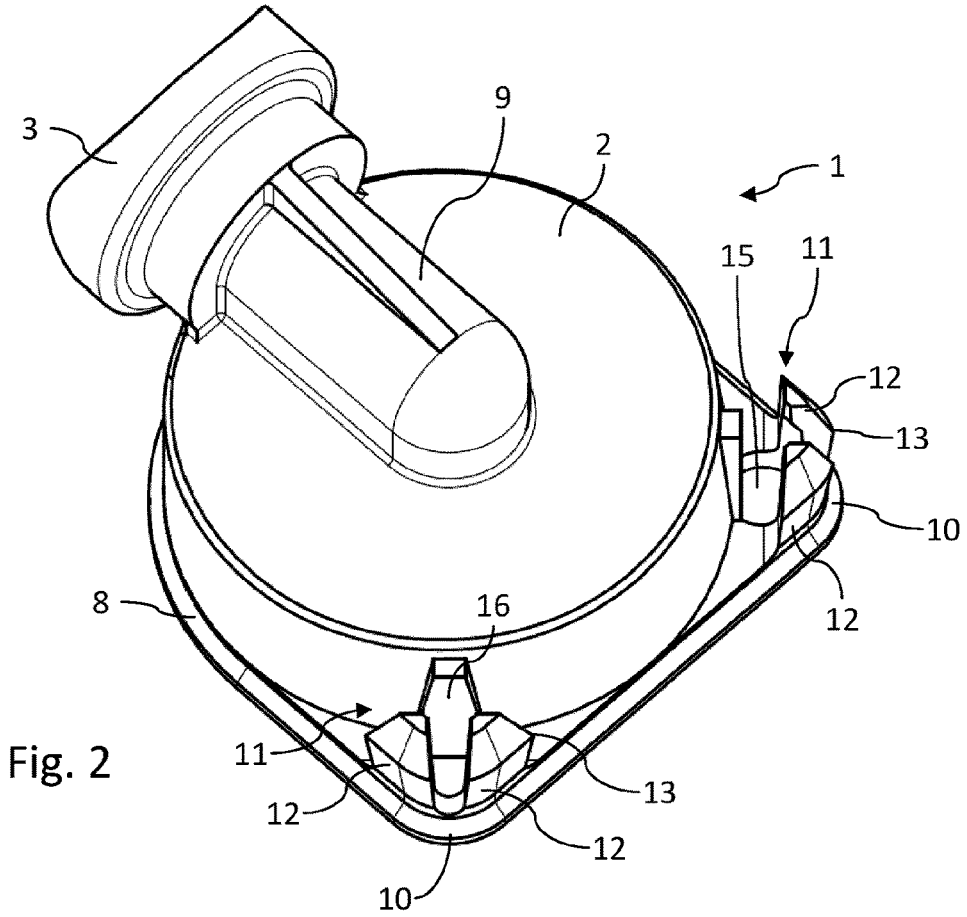
FIG. 2: shows a further view of the sanitary outflow unit of FIG. 1, FIG. 3: shows a schematic representation of a sanitary outflow unit for the purpose of illustrating the peripheral contour.

FIGS. 1 and 2 show a sanitary outflow unit, which is denoted as a whole by 1. The sanitary outflow unit 1 has a basic body 2, a water connection 3 and a water outlet 4.

The water connection 3 has a plug-in connector for connection to a hose 31 (cf. FIGS. 13, 14, 16, 17). As an alternative, the water connection 3 may also have other types of connection, for instance a pressed connection to a pipe.

The water outlet 4 has a substantially cylindrical space 5, which is open at one end. The other end of the space 5 opens out into a pipe section 9, at the free end of which is arranged the water connection 3. In the example shown, the pipe section 9 forms a right angle to the longitudinal axis of the space 5. However, for other installation situations (e.g. FIGS. 13, 14, 16, 17), the pipe section may also be arranged at a different angle.

In addition, an internal thread 6 is arranged at the open end of the space 5, in particular for screwing in a jet regulator 23 (cf. e.g. FIG. 4, 5, 9, 10 or 17), a flow rate regulator or a combination of the two. As an alternative, the jet regulator may already be arranged in the water outlet 4. The basic body 2 or the sanitary outflow unit 1 overall may also be formed in one piece with a jet regulator.

The basic body 2 has a front panel 7, which is arranged at the open end of the space 5 and has an enlarged diameter, resulting in the formation of a border 8 which projects radially beyond the outer periphery of the space 5. In the example, the border 8 has a rectangular widening at the end opposite the water connection 3, resulting in the formation of two corners 10.

Figure 4:
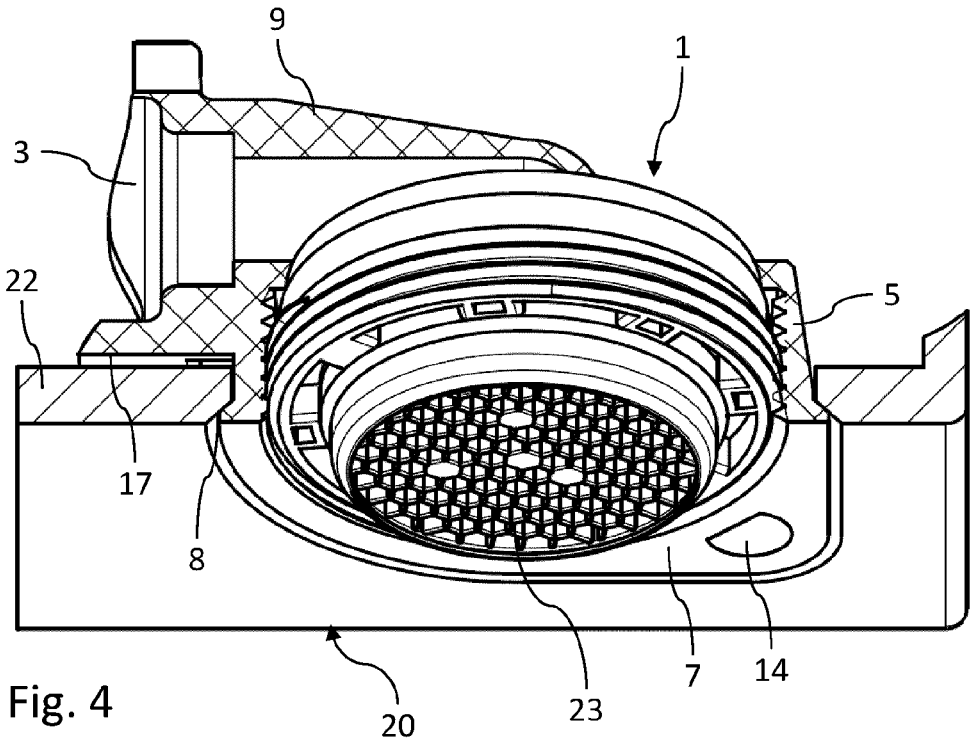
FIG. 4: shows a sectional representation of a water dispensing device according to the invention with a sanitary outflow unit according to the invention as per
Figure 5:
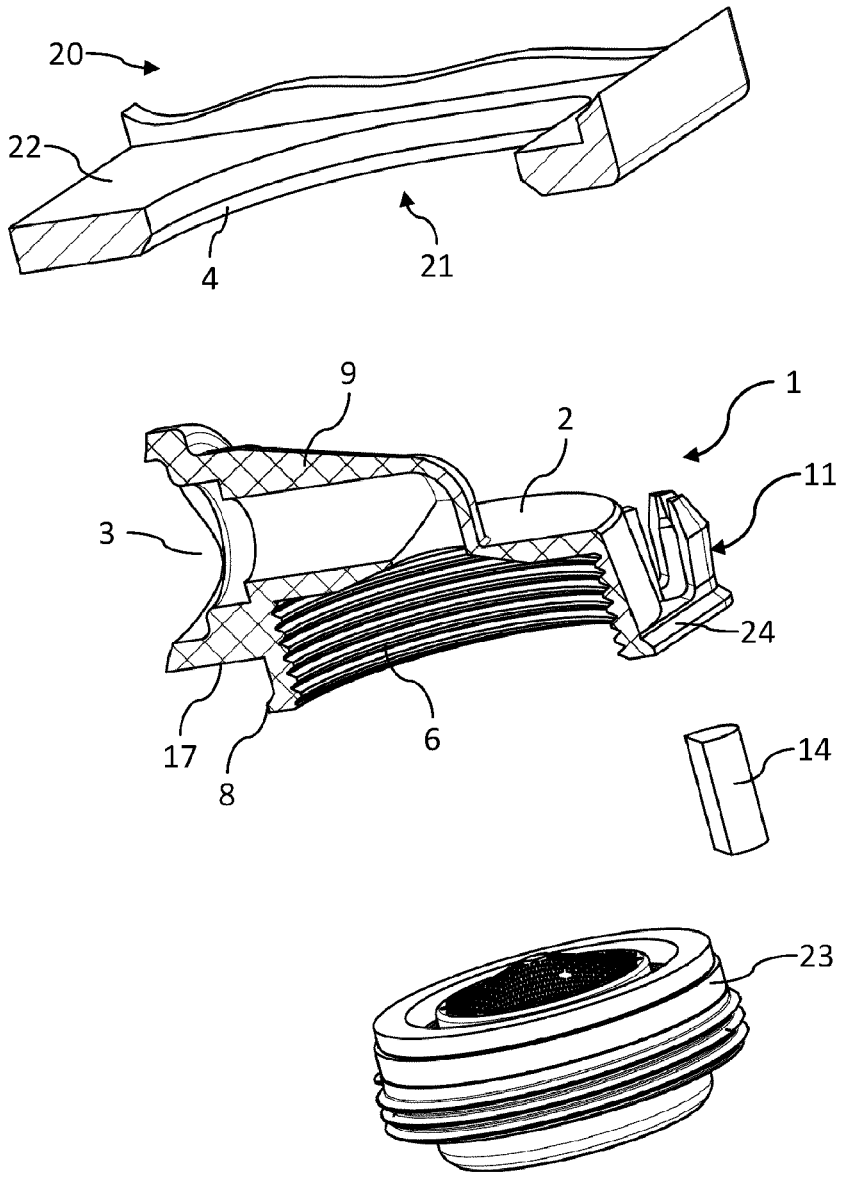

A holding element 11 is arranged in each corner 10. A holding element 11 has two bending elements 12, each of which has an outwardly protruding holding lug 13. If the sanitary outflow unit 1 is installed in a water dispensing device 20, this holding lug 13 engages behind a wall 22 of the water dispensing device 20 and thus ensures a secure hold, as shown in FIG. 4.

Between the wall of the space 5 and the bending elements 12, the corner 10 has an introduction opening 15, into which a locking element 14 can be inserted.

Arranged at the outer periphery of the space 5 in the region of the introduction opening 15 and opposite the bending elements 12 is a sliding surface 16, along which the locking element 14 slides when it is being introduced and on which the locking element is supported with respect to the bending elements 12. The sliding surface 16 thus forms an abutment for the locking element 14 in order to apply a holding force against the bending elements 12.

The water connection 3 forms a support 17, which engages behind a wall of a water dispensing device, on that end of the sanitary outflow unit 1 that faces away from the holding elements 11.

When being introduced into an installation opening 21, the bending elements 12 are bent inward by the boundary of the installation opening 21, with the result that the holding element 11 enters a release position, which makes insertion possible. In the installed state, the locking elements 14 are inserted into the introduction openings 15 provided for this. As a result, the bending elements 12 are moved into their starting position and the holding element 11 is transferred into its holding position.

Figure 3:
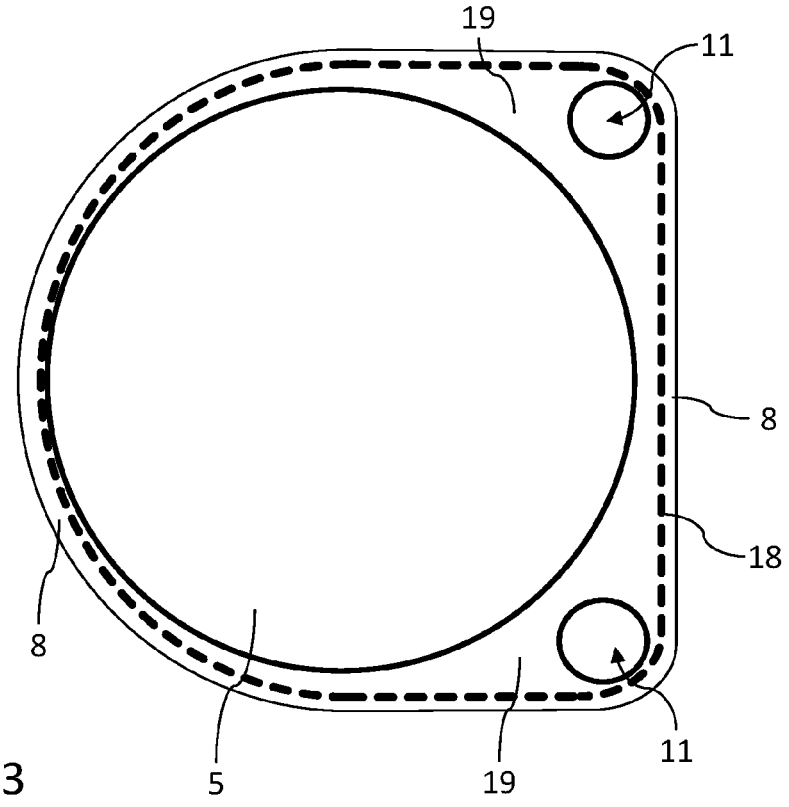

The sanitary outflow unit 1 has a peripheral contour 18, which is illustrated in FIG. 3. The peripheral contour 18 is spanned substantially by the outer wall of the space 5 and the two holding elements 11. However, the peripheral contour 18 does not necessarily follow the or a physical boundary of the sanitary outflow unit 1. As can be seen in FIG. 3, there are regions 19 between the holding elements 11 and the space 5, in which regions the peripheral contour 18 practically runs "in the air". In this respect, the peripheral contour 18 essentially defines a simple installation dimension of the sanitary outflow unit 1, this installation dimension corresponding to the largest installation opening 21. The installation opening 21 may in fact be smaller than the peripheral contour 18, for example by replicating the rounded portions of the space 5. In any case, the peripheral contour 18 never runs outside the border 8, and therefore the border forms a support surface at each point.

FIGS. 4 to 8 show a water dispensing device 20 with a sanitary outflow unit 1 according to the invention. Such a water dispensing device 20 may be for example an item of furniture, in particular an item of sanitary furniture, a fitting or another water dispensing device. In the example, a jet regulator 23 is screwed in the internal thread 6 of the sanitary outflow unit 1.

The water dispensing device 20 has an installation opening 21, which corresponds substantially to the peripheral contour 18 of the sanitary outflow unit 1. The installation opening 21 is arranged in a wall 22 of the water dispensing device 20.

The sanitary outflow unit 1 has two holding elements 11 and a water connection 3, which simultaneously serves as a support 17 that engages behind the wall 22, on its end opposite the holding elements 11. The wall 22 thus lies in the region of the water connection 3 between the border 8 and the support 17, the wall 22 preferably being clamped such that a wobble-free seat is ensured.

In the example, the front panel 7 of the sanitary outflow unit 1 has a flush configuration with the wall 22. The locking element 14 is likewise arranged flush with the front panel 7, with the result that overall a surface which is flat and easy to clean is formed. For this purpose, the installation opening 21 has a bevel 24 into which the border 8 sinks. The border 8 may likewise have a bevel for this.

Figure 6:
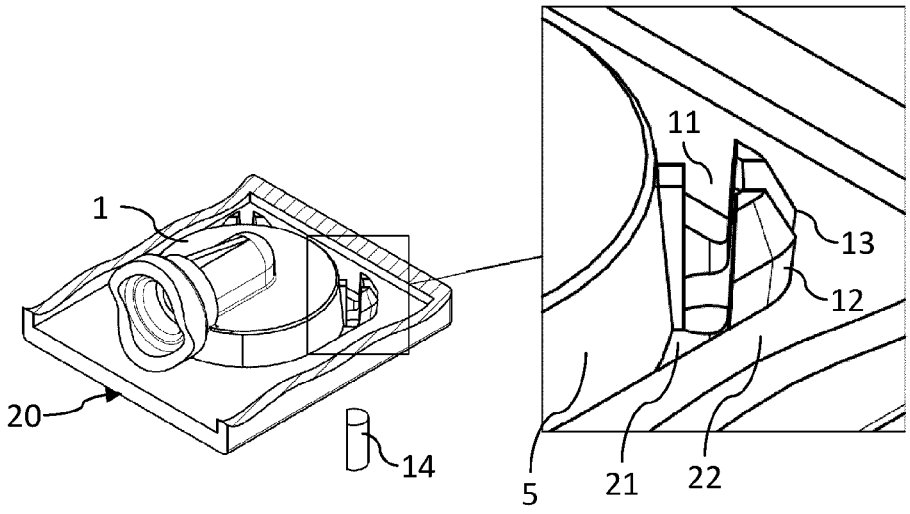
Figure 7:
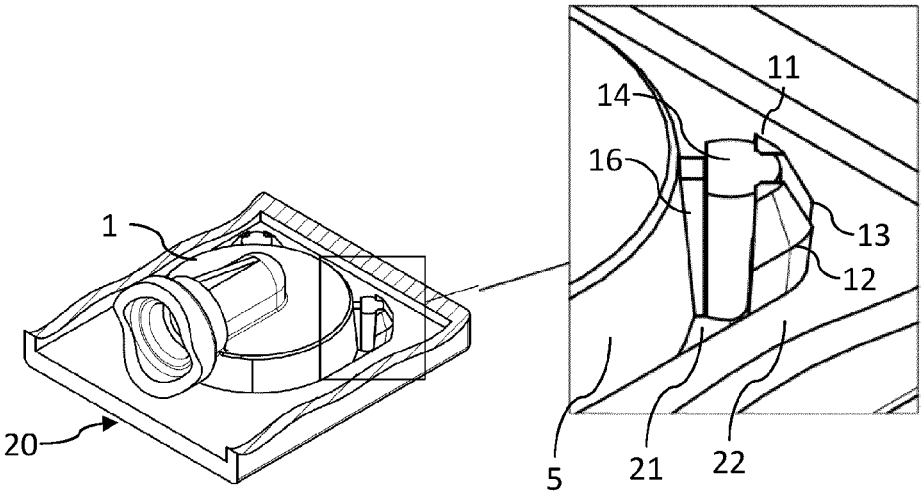
FIG. 7: shows a representation of the water dispensing device of FIG. 4 with locking elements inserted in the holding elements.

The holding lugs 13 engage behind the wall 22 at the holding elements 11. When the sanitary outflow unit 1 is being inserted into the installation opening 21, the bending elements 12 of the holding elements 11 are firstly bent by the wall 22 into a release position, making insertion possible. In the installation position, the bending elements 12 relax and the holding elements 11 return to their holding position, as represented in FIG. 6. In order to be fixed in place, now the locking elements 14 are pushed into the introduction openings 15 provided for this. In connection with the sliding surfaces 16, these locking elements now exert a holding force on the bending elements 12, with the result that the holding elements 11 are held in their holding position, as represented in FIG. 7.

In this respect, the holding lugs 13 enlarge the peripheral contour 18 in the holding position, as a result of which the sanitary outflow unit 1 is held securely in the installation opening 21.

Figure 8:
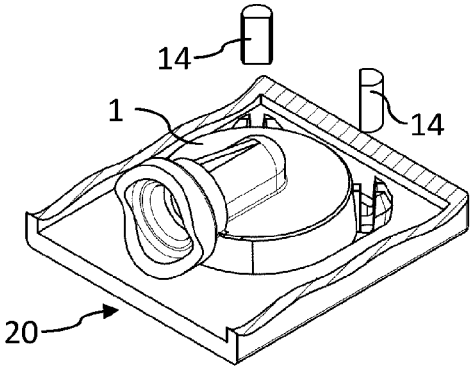
FIG. 8: shows a representation of the water dispensing device of FIG. 4 with locking elements that have been pushed through inward.

In order to remove the sanitary outflow unit 1, the locking elements 14 according to FIG. 8 can be pushed through inward so that the bending elements 12 are released. By pulling the sanitary outflow unit 1, the bending elements 12 are bent into their release position again by the wall 22 and the sanitary outflow unit 1 can be removed from the installation opening 21. The free locking elements 14 can be picked up and reused for locking again.

Figure 9:
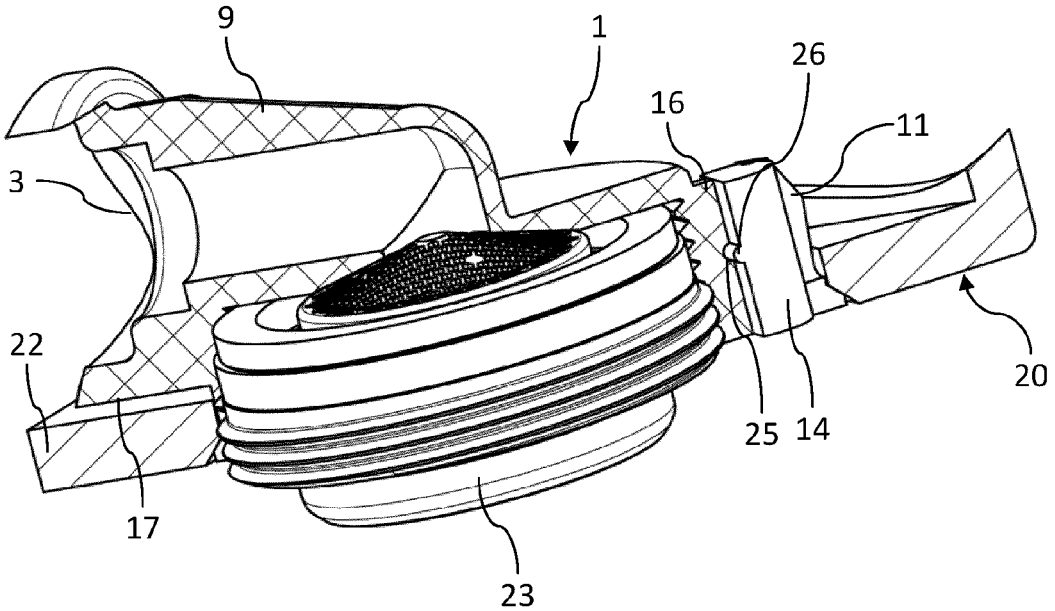
FIG. 9: shows a sectional representation of a water dispensing device with a sanitary outflow unit according to the invention with an arresting means.

FIG. 9 shows a sanitary outflow unit 1, which corresponds substantially to the embodiment of the previous drawings. In this instance, however, the sanitary outflow unit 1 additionally has a groove 25 or depression in the form of arresting means on the sliding surface 16. Matching this, the locking element 14 has a latching lug 26 in the form of arresting means. In the second position of the locking element 14, that is to say in the holding position of the holding element 11, the latching lug 26 engages into the groove 25 and thus prevents the locking element 14 from sliding out and ensures that the outflow-side end face of the locking element 14 terminates flush in a plane with the end face of the basic body 2 and/or of the front panel 7.

Figure 10:
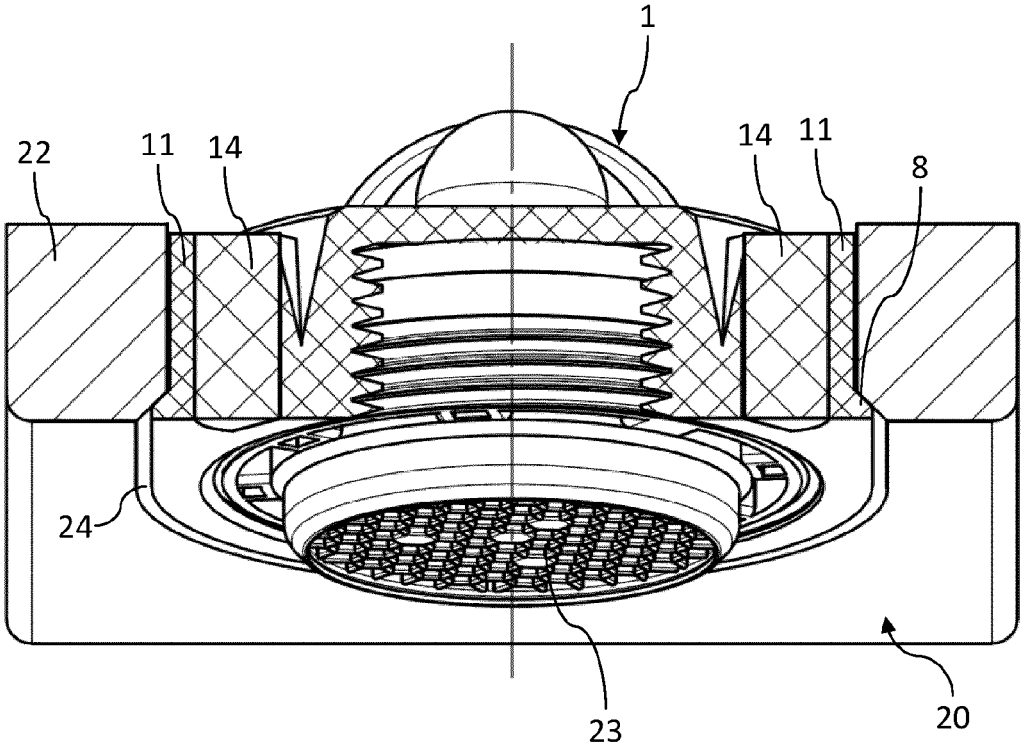
FIG. 10: shows a sectional representation of a water dispensing device with a further sanitary outflow unit according to the invention.

FIG. 10 shows a further embodiment of the invention. In this case, the holding element 11 does not enlarge the peripheral contour in the holding position. Instead, the sanitary outflow unit 1 is held in the installation opening 21 by a press fit. Here, the holding force is also generated by locking elements 14 that hold the holding elements 11 in the holding position in a press fit. In addition, it is also possible here for arresting means as shown in FIG. 9 to be present.

In this embodiment, the sanitary outflow unit 1 does not engage behind the wall 22 of the water dispensing device 20, which means that this embodiment can be advantageous in particular for thicker walls 22.

Figure 11:
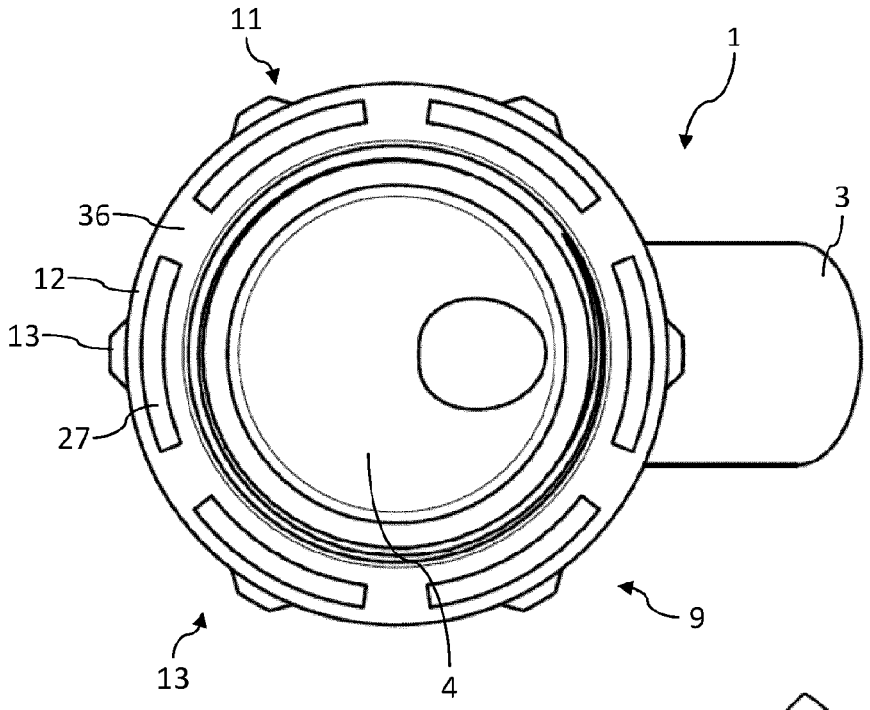
FIG. 11: shows a view from below of a further sanitary outflow unit according to the invention.
Figure 12:
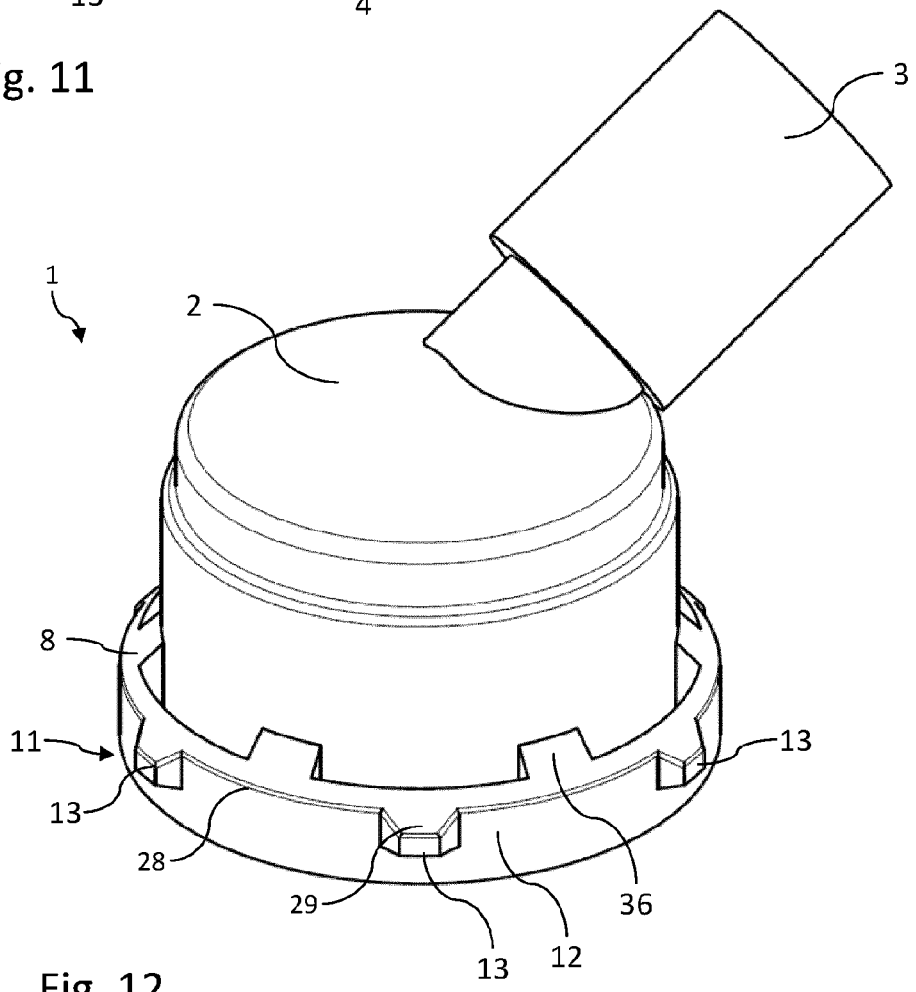
FIG. 12: shows an oblique representation of the sanitary outflow unit of FIG. 11, FIG. 13: shows a fitting with a sanitary outflow unit according to FIG. 11 in an introduced position.

FIGS. 11 and 12 show a second embodiment of a sanitary outflow unit 1. The sanitary outflow unit 1 has substantially the same features as the sanitary outflow unit 1 of FIG. 1. Therefore, only features that differ from FIG. 1 are explained in more detail below. Identical features are labeled in the figures with the same reference signs.

In the embodiment shown, the pipe section 9 forms an obtuse angle to the longitudinal axis of the space 5. However, for other installation situations, the pipe section may also be arranged at a different angle.

In this example, the sanitary outflow unit 1 has a circular border 8 on which six holding elements 11 are arranged in a manner uniformly spaced apart from one another.

A holding element 11 has a bending element 12, which is in the form of a bending web. For this purpose, the border 8 has an arcuate recess 27. A holding lug 13, which projects beyond the border 8 radially outward, is arranged approximately in the middle of the bending element 12. In the example shown, the holding lug 13 is in line with the inner axial edge 28 of the border 8. The holding lugs 13 have a slope 29, with the result that the radial extent decreases toward the inner edge 28. The holding lug 13 extends in the axial direction approximately over half of the height of the border 8. A holding edge 33 is arranged at that axial end of the retaining lug 13 that faces away from the inner edge.

In the example shown, in the peripheral direction the six bending elements 12 are longer overall than half of the periphery of the border 8. In this case, in particular, in the peripheral direction the individual bending elements 12 are each longer than the webs 36 between the bending elements 12. In the example, the webs 36 project in the axial direction beyond the inner edge 28 of the border. It is particularly advantageous here if the webs 36 and the inner edge 28 continue the slope 29 of the holding lug 13, with the result that they form part of a lateral surface of a cone.

Figure 13:
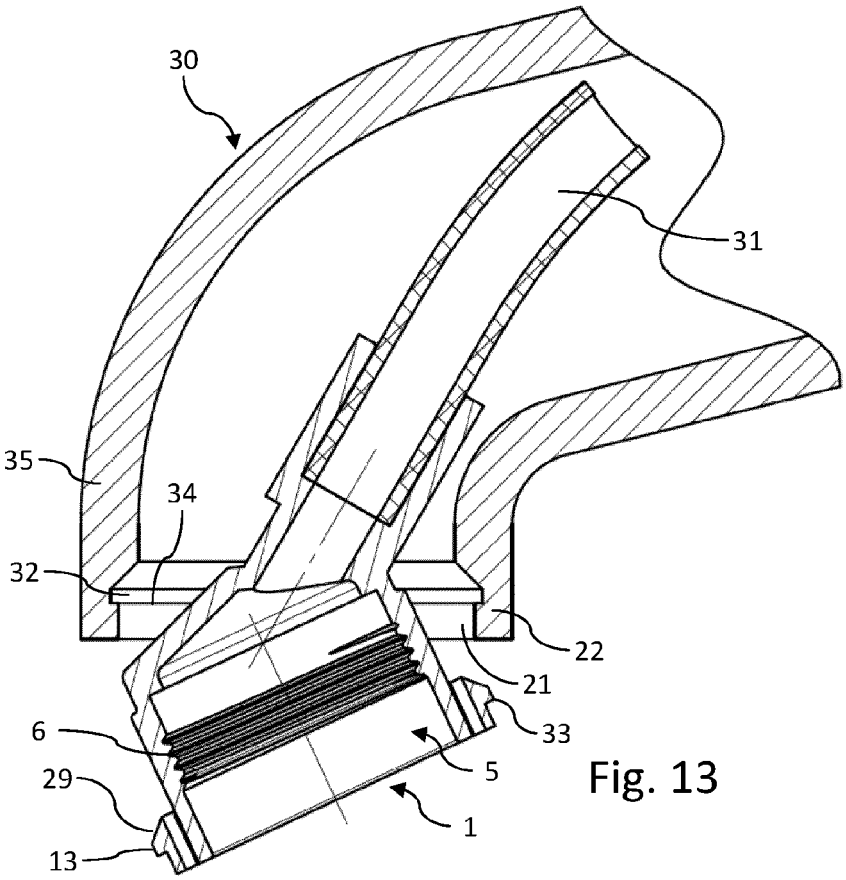

FIG. 13 shows a fitting 30 with a sanitary outflow unit according to FIG. 11 in a first introduced position. The fitting 30 has a tubular outflow 35 with an installation opening 21 for inserting a sanitary outflow unit 1. In this case, the diameter of the installation opening 21 corresponds substantially to the diameter of the border 8 of the sanitary outflow unit. Instead of the fitting 30 shown, another water dispensing device 20 similar to the preceding FIGS. 1 to 10 may be present, for example an item of furniture, in particular an item of sanitary furniture.

The installation opening 21 has a peripheral recess 32 in the wall 22, into which the holding lugs 13 of the sanitary outflow unit 1 engage. Accordingly, the recess 32 is sloped in the axial direction and has a holding edge 34 toward the open end.

Instead of the peripheral recess 32, it is also possible for individual recesses to be present, as a result of which the sanitary outflow unit 1 can be inserted only in certain positions. In particular, the holding lugs 13 may have dimensions that vary in the peripheral direction in order to permit only one defined installation position, such that incorrect assembly can be prevented. In this way, it is possible to avoid any damage that may result from incorrect assembly.

Here, the water connection 3 of the sanitary outflow unit 1 is connected to a hose 31, which is guided through the fitting 30. The sanitary outflow unit 1 is introduced obliquely into the installation opening 21 for assembly in the fitting 30.

Figure 14:
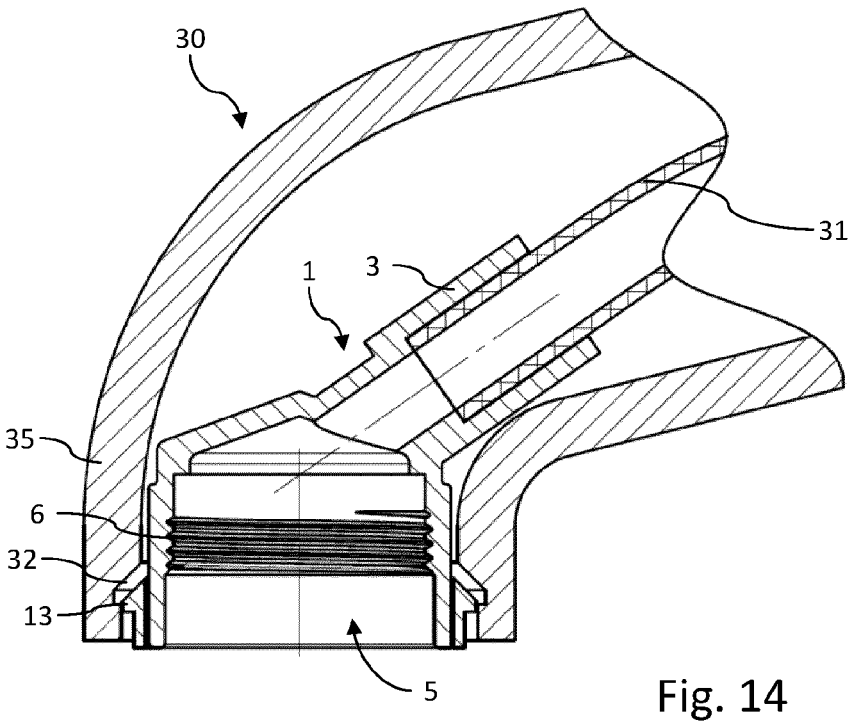
FIG. 14: shows the fitting of FIG. 13 with the sanitary outflow unit in a second introduced position.
Figure 15:
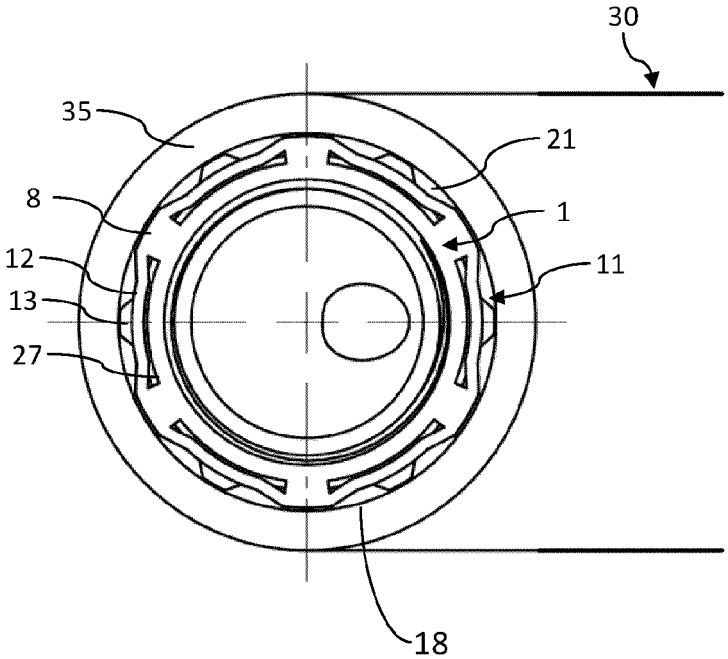
FIG. 15: shows a view from below of the fitting of FIG. 14, FIG. 16: shows the fitting of FIG. 13 with the sanitary outflow unit in the final position

In FIG. 14, the sanitary outflow unit 1 is shown in a second installation position. Since the holding lugs 13 project beyond the border 8, the holding lugs touch the inner periphery of the installation opening 21. The slope of the holding lugs 13 exerts a radial force on the bending elements 12 when the sanitary outflow unit 1 is being introduced into the installation opening 21, as a result of which the bending elements 12 are deflected radially inward. FIG. 15 illustrates this second installation position. Here, it can be seen that the bending elements 12 are deflected radially inward far enough that the holding lugs 13 lie on the periphery of the border 8. This makes it possible to introduce the sanitary outflow unit 1 into the installation opening 21. It is also the case here that the holding lugs 13 define a peripheral contour 18, which in the relaxed position of the bending elements 12 is larger than an inner contour of the installation opening 21.

Figure 16:
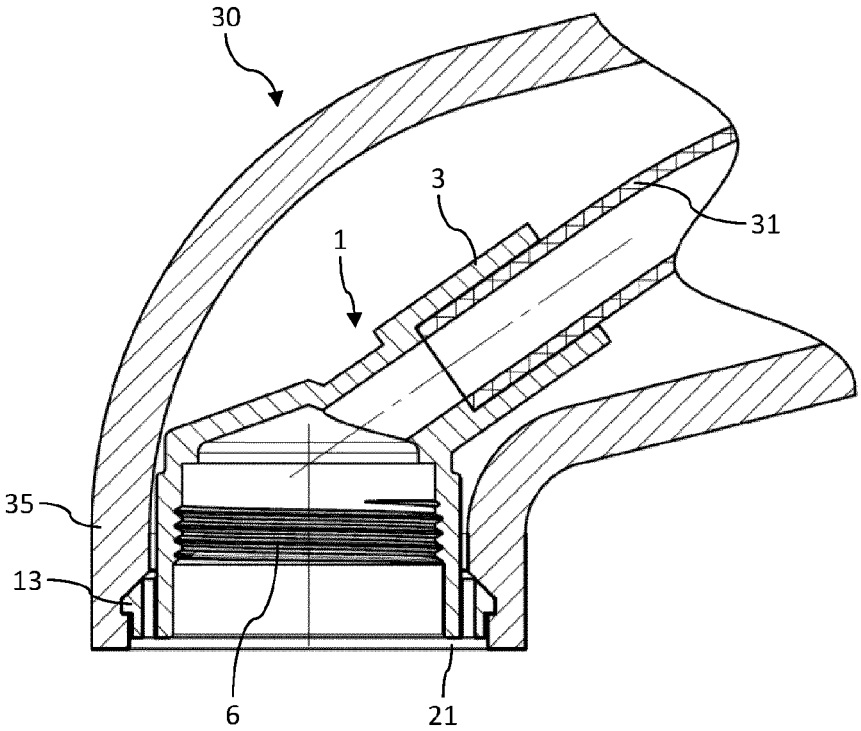

FIG. 16 shows the final position of the sanitary outflow unit. Here, the holding lugs 13 engage into the recess 32, as a result of which the bending elements 12 are at least partially relaxed. The holding edge 33 of the holding lugs 13 engages into the holding edge 34 of the recess 32 and thus prevents the sanitary outflow unit 1 from falling out of the installation opening 21.

Figure 17:
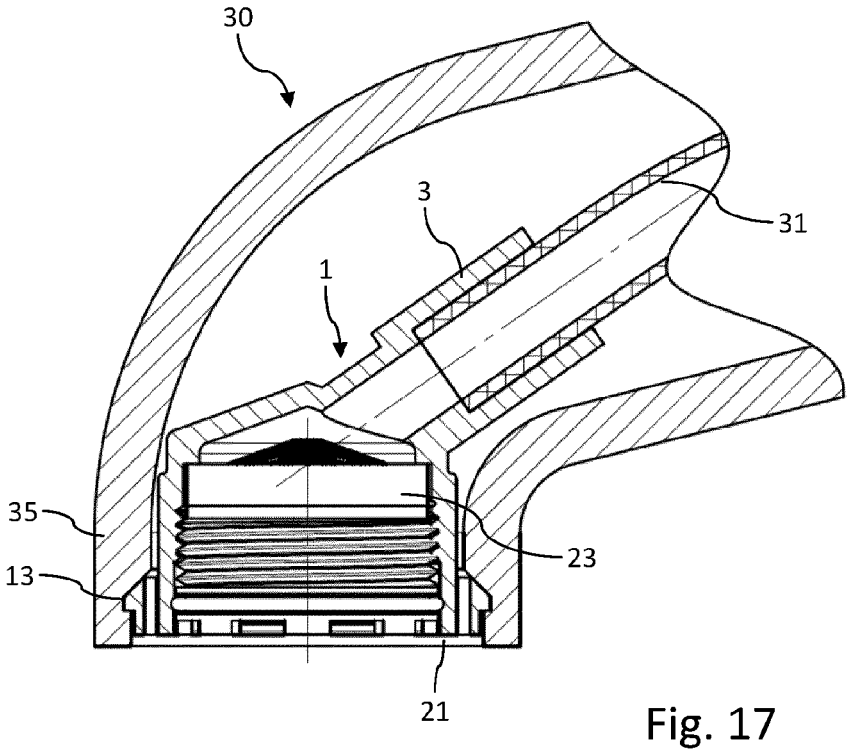
FIG. 17: shows the fitting of FIG. 16 with an inserted jet regulator.

Finally, FIG. 17 shows the finished fitting 30, in which a jet regulator 23 has been screwed into the sanitary outflow unit 1.

LIST OF REFERENCE SIGNS

1 Sanitary outflow unit
2 Basic body
3 Water connection
4 Water outlet
5 Space
6 Internal thread
7 Front panel
8 Border
9 Pipe section
10 Corners
11 Holding element
12 Bending elements
13 Holding lug
14 Locking element
15 Introduction opening
16 Sliding surface
17 Support
18 Peripheral contour
19 Regions
20 Water dispensing device
21 Installation opening
22 Wall
23 Jet regulator
24 Bevel
25 Groove
26 Latching lug
27 Recess in the sanitary outflow unit
28 Inner edge of the border
29 Slope
30 Fitting

31 Hose
32 Recess in the fitting
33 Holding edge of the sanitary outflow unit
34 Holding edge of the fitting
35 Outflow of the fitting
36 Web

The invention claimed is:

1. A sanitary outflow unit (1) for insertion into a water dispensing device (20), the sanitary outflow unit (20) comprising:

a housing having a water connection (3) and a water outlet (4), that includes a substantially cylindrical space (5), which is open at one end, and includes threads (6) for receiving a jet regulator;

at least one holding element (11) on the housing that is spaced apart from the substantially cylindrical space (5), the at least one holding element (11) is switchable between a release position and a holding position and includes a holding lug (13), which is at least one of engageable behind or engages behind a wall (22) of the water dispensing device (20) at least partially in the holding position; and wherein the sanitary outflow unit (1) has a larger peripheral contour (18) in the holding position than in the release position.

2. The sanitary outflow unit (1) as claimed in claim 1, wherein the holding element (11) includes an elastic bending element (12).

3. The sanitary outflow unit (1) as claimed in claim 1, wherein the peripheral contour (18) of the sanitary outflow unit (1) is enlarged by the holding element (11) in the holding position.

4. The sanitary outflow unit (1) as claimed in claim 3, further comprising a border (8), which defines the peripheral contour (18).

5. The sanitary outflow unit (1) as claimed in claim 4, wherein the holding element (11) includes an elastic bending element (12), and the bending element (12) comprises a bending web.

6. The sanitary outflow unit (1) as claimed in claim 5, wherein the bending element (12) is held on one side or on two sides, and is deformable transversely to a direction of insertion of the sanitary outflow unit (1).

7. The sanitary outflow unit (1) as claimed in claim 1, wherein at least one of the water connection (3) comprises a plug-in connection, a valve is arranged in the water connection (3), or a jet regulator (23) is inserted or is insertable in the water outlet (4).

8. The sanitary outflow unit (1) as claimed in claim 1, further comprising a receptacle for inserting a jet regulator (23).

9. A combination of the sanitary outflow unit (1) as claimed in claim 1 and a water dispensing device (20; 30), wherein the water dispensing device (20) has an installation opening (21) matched to the peripheral contour (18) of the sanitary outflow unit (1) and the holding element (11) engages behind a wall (22) of the water dispensing device (20) in the holding position.

10. A water dispensing device (20) comprising the sanitary outflow unit (1) as claimed in claim 1.

11. A sanitary outflow unit (1) for insertion into a water dispensing device (20), the sanitary outflow unit (20) comprising:

a housing having a water connection (3) and a water outlet (4), that includes a substantially cylindrical space (5), which is open at one end, and includes threads (6) for receiving a jet regulator;

at least one holding element (11) on the housing that is spaced apart from the substantially cylindrical space (5), the at least one holding element (11) is switchable between a release position and a holding position, wherein the sanitary outflow unit (1) has a larger peripheral contour (18) in the holding position than in the release position; and a locking element (14), which is displaceable in order to move or hold the holding element (11) between a first position, in which the holding element (11) is in the release position, and a second position, in which the holding element (11) is in the holding position, and the peripheral contour (18) runs peripherally around the locking element (14) at least in the holding position.

12. The sanitary outflow unit (1) as claimed in claim 11, wherein the locking element (14) at least one of comprises a pin or has a round or oval cross section.

13. A sanitary outflow unit (1) for insertion into a water dispensing device (20) with a water connection (3) and a water outlet (4), the sanitary outflow unit (1) comprising: at least one holding element (11) which is switchable between a release position and a holding position, and the sanitary outflow unit (1) has a larger peripheral contour (18) in the holding position than in the release position, and at least one arresting element (25), which interacts with a further arresting element in the holding position, and the further arresting element (26) is arranged on at least one of the holding element (11), a locking element (14), or on a housing wall (22) of the water dispensing device.

14. A sanitary outflow unit (1) for insertion into a water dispensing device (20), the sanitary outflow unit (20) comprising:

a housing having a water connection (3) and a water outlet (4), that includes a substantially cylindrical space (5), which is open at one end, and includes threads (6) for receiving a jet regulator;

at least one holding element (11) on the housing that is spaced apart from the substantially cylindrical space (5), the at least one holding element (11) is switchable between a release position and a holding position, wherein the sanitary outflow unit (1) has a larger peripheral contour (18) in the holding position than in the release position; and an introduction opening (15) for introducing a locking element (14) located in a region of the holding element, and the holding element (11) is at least one of moved into, movable into, or is held in the holding position by introducing the locking element (14).

15. The sanitary outflow unit (1) as claimed in claim 14, wherein the locking element (14) is completely removable from the introduction opening (15).

16. The sanitary outflow unit (1) as claimed in claim 14, wherein at least one of the sanitary outflow unit (1) or the holding element (11) has a sliding surface (16), on which the locking element (14) is supported when being introduced into the introduction opening (15) in order to move the holding element (11).

17. A sanitary outflow unit (1) for insertion into a water dispensing device (20), the sanitary outflow unit (20) comprising:

a housing having a water connection (3) and a water outlet (4), that includes a substantially cylindrical space (5), which is open at one end, and includes threads (6) for receiving a jet regulator;

at least one holding element (11) on the housing that is spaced apart from the substantially cylindrical space (5), the at least one holding element (11) is switchable between a release position and a holding position, wherein the sanitary outflow unit (1) has a larger peripheral contour (18) in the holding position than in the release position; and a support (17), which is engageable behind or engages behind a wall (22) of a water dispensing device (20), on a side facing away from the holding element (11).

18. A sanitary outflow unit (1) for insertion into a water dispensing device (20) with a water connection (3) and a water outlet (4), the sanitary outflow unit (1) comprising: at least one holding element (11) which is switchable between a release position and a holding position, and the sanitary outflow unit (1) has a larger peripheral contour (18) in the holding position than in the release position, wherein the bending element (12) is formed by an arcuate recess (27) in the border (8) of the sanitary insert part (1).

19. The sanitary outflow unit (1) as claimed in claim 18, wherein a holding lug (13) is arranged on a radial outer surface of the bending element (12), and the holding lug (13) extends in an axial direction approximately over half of a height of the border (8).

20. The sanitary outflow unit (1) as claimed in claim 19, wherein the holding lug (13) projects beyond the border (8) of the sanitary outflow unit (1) radially outward.

21. The sanitary outflow unit (1) as claimed in claim 20, wherein the holding lug (13) has a slope (29) configured such that a radial extent decreases toward an inner edge (28) of the sanitary outflow unit (1), and a holding edge (33), which is engageable behind a holding edge (34) of a fitting (30) that forms the water dispensing device, is arranged on that axial end of the holding lug (13) that faces away from an inner edge (2).

22. The sanitary outflow unit (1) as claimed in 21, wherein the at least one holding element comprises a plurality of holding elements (11) that are arranged distributed along the border (8).

23. The sanitary outflow unit (1) as claimed in claim 22, wherein in the peripheral direction the bending elements (12) are longer overall than half of the periphery of the border (8), and in the peripheral direction the bending elements (12) are each longer than the webs (36) between the bending elements.

* * * * *